US005694915A

United States Patent [19]

Summers

[11] Patent Number: 5,694,915

[45] Date of Patent: Dec. 9, 1997

[54] BACK TENSION ROPE RELEASE

[76] Inventor: Gregory E. Summers, 105 Overlink Ct., Lynchburg, Va. 24503

[21] Appl. No.: 781,148

[22] Filed: Jan. 9, 1997

[51] Int. Cl.[6] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 2,417,791 | 3/1947 | Tyszkiewicz . | |
| 2,488,597 | 11/1949 | Konold . | |
| 2,637,311 | 5/1953 | Rose . | |
| 2,777,437 | 1/1957 | Allen . | |
| 2,819,707 | 1/1958 | Kayfes et al. . | |
| 2,905,166 | 9/1959 | Niemeyer . | |
| 2,965,093 | 12/1960 | Arsenault . | |
| 2,977,952 | 4/1961 | Gabriel et al. . | |
| 3,768,456 | 10/1973 | Hansen et al. | 124/35.2 |
| 3,847,133 | 11/1974 | Awiszus . | |
| 3,853,111 | 12/1974 | Stanislawski et al. | 124/35.2 |
| 3,965,884 | 6/1976 | Killian | 124/35.2 |
| 4,086,904 | 5/1978 | Suski et al. | 124/90 |
| 4,134,369 | 1/1979 | Cook | 124/35.2 |
| 4,151,825 | 5/1979 | Cook | 124/35.2 |
| 4,282,851 | 8/1981 | Lyons | 124/35.2 |
| 4,509,497 | 4/1985 | Garvison | 124/35.2 |
| 4,539,968 | 9/1985 | Garvison | 124/35.2 |
| 4,620,523 | 11/1986 | Peck | 124/35.2 |
| 4,656,994 | 4/1987 | Jenks . | |
| 4,674,469 | 6/1987 | Peck | 124/35.2 |
| 4,691,683 | 9/1987 | Peck | 124/35.2 |
| 4,722,319 | 2/1988 | Brady | 124/35.2 |
| 4,791,908 | 12/1988 | Pellis | 124/35.2 |
| 4,881,516 | 11/1989 | Peck | 124/35.2 |
| 4,909,233 | 3/1990 | Stephenson | 124/91 |
| 4,926,835 | 5/1990 | Peck | 124/35.2 |
| 4,930,485 | 6/1990 | Kopper | 124/91 |
| 4,981,128 | 1/1991 | Garvison | 124/35.2 |
| 5,016,603 | 5/1991 | Tentler | 124/91 |
| 5,020,508 | 6/1991 | Greene, Jr. | 124/35.2 |
| 5,027,786 | 7/1991 | Peck | 124/35.2 |
| 5,070,854 | 12/1991 | Peck | 124/35.2 |
| 5,076,251 | 12/1991 | Peck | 124/35.2 |
| 5,078,116 | 1/1992 | Peck | 124/35.2 |
| 5,103,796 | 4/1992 | Peck | 124/35.2 |
| 5,170,771 | 12/1992 | Peck | 124/35.2 |
| 5,170,772 | 12/1992 | Hamm | 124/35.2 |
| 5,247,921 | 9/1993 | Todd | 124/35.2 |
| 5,263,466 | 11/1993 | Peck | 124/35.2 |
| 5,287,842 | 2/1994 | Saunders | 124/91 |
| 5,318,004 | 6/1994 | Peck | 124/35.2 |
| 5,359,983 | 11/1994 | Peck | 124/35.2 |
| 5,361,747 | 11/1994 | Laabs | 124/91 |
| 5,370,102 | 12/1994 | Peck | 124/35.2 |
| 5,390,657 | 2/1995 | Larson | 124/91 |

*Primary Examiner*—John A. Ricci
*Attorney, Agent, or Firm*—Nixon & Vanderhye P.C.

[57] ABSTRACT

A rope release for a bowstring includes a handle, a fork mounted in the handle for adjustable rotation relative thereto about a first axis, a rope release catch member mounted in the fork for adjustable rotation relative to the fork member about a second axis perpendicular to the first axis, and a rope release fixed to the catch with a closed loop adapted to be releasably engaged by a spike formed integrally on the catch member.

12 Claims, 2 Drawing Sheets

BACK TENSION ROPE RELEASE

This invention relates to a bowstring release and, more specifically, to a back-tension spike release.

BACKGROUND AND SUMMARY OF THE INVENTION

Various release devices are utilized in archery to assist the archer in pulling a bowstring to a fully drawn position and then releasing the bowstring to fire the arrow. Many of these devices include mechanical grippers which engage the bowstring directly, or which engage hock elements mounted on the bowstring. Other devices use rope looped about the bowstring as the release mechanism. In release devices of the latter kind, the looped rope is often subject to a twisting action as the archer draws the bowstring to a fully drawn position due to a cocking or turning action of the archer's wrist. This kind of twist or torque applied to the release rope can result in reduced arrow speed and accuracy.

It is the principal object of this invention to provide a rope release device which eliminates torque at full draw. In addition, the rope release permits adjustment of back tension by changing the angle of the bowstring restraining hook or spike on the device prior to draw.

In accordance with an exemplary embodiment of this invention, rope release is provided which affords the archer two degrees of adjustability heretofore unavailable in rope releases. More specifically, the rope release includes a handle which may be of two, three or four finger design, and a catch member adjustably supported within a fork member which, in turn, is threadably received within a post extending forwardly between adjacent finger grooves in the handle.

A first degree of adjustability is achieved by having the fork member fixed to a hollow, threaded stud which is threadably received into the handle post, the latter having a threaded bore extending to the back edge of the handle. With the fork threadably engaged within the post, a first set screw is inserted into the threaded bore from the back edge of the handle, and threaded into abutting engagement with the rear end of the stud. It will thus be appreciated that the stud (and, hence the fork and the catch) can be locked in any rotational orientation relative to the handle. With this arrangement, the archer simply adjusts the rotation of the catch to the desired setting to insure unwinding of rope twist at full draw. In other words, the archer can pre-adjust the catch to accommodate the amount of twist he normally applies during draw, so that at full draw, there is no twist or torque applied to the release rope.

A second degree of adjustability is achieved by the catch being pivotally supported within the fork for rotation about a pivot pin extending perpendicularly relative to the handle post. In other words, the fork acts as a cradle, with the catch mounted for pivotal motion therein. A second set screw is provided to lock the catch at a desired angle relative to the fork. With this second adjustment, the desired back tension on the release rope can be set.

The catch member itself is formed with a curved rear surface engageable with the second set screw, and a spike and associated groove for retaining the release rope, after the latter has been wrapped around the bowstring. The catch is also formed with a spike (or hook) and an adjacent groove which is adapted to be engaged by a loop of the release rope. Finally, the catch is formed with three holes by which two free ends of the release rope are secured to the catch, thereby forming a closed loop in the release rope.

With the catch member adjusted as desired, and with the release rope wrapped about the bowstring and retained in the groove behind the spike, the bowstring may be pulled to the fully drawn position. The archer can then fire the arrow simply by tilting the release sufficiently to cause the release rope to slip off the spike on the catch member.

Thus, in accordance with one aspect of the invention, there is provided a rope release for a bowstring comprising a handle; a fork mounted in the handle for adjustable rotation relative thereto about a first axis; a rope release catch member mounted in the fork for adjustable rotation relative to the fork member about a second axis perpendicular to the first axis; and a rope release fixed to the catch member with a closed loop adapted to be releasably engaged by a spike formed integrally on the catch member.

Other objects and advantages will become apparent from the detailed description which follows.

DETAILED DESCRIPTION OF THE DRAWINGS

Figure 1:
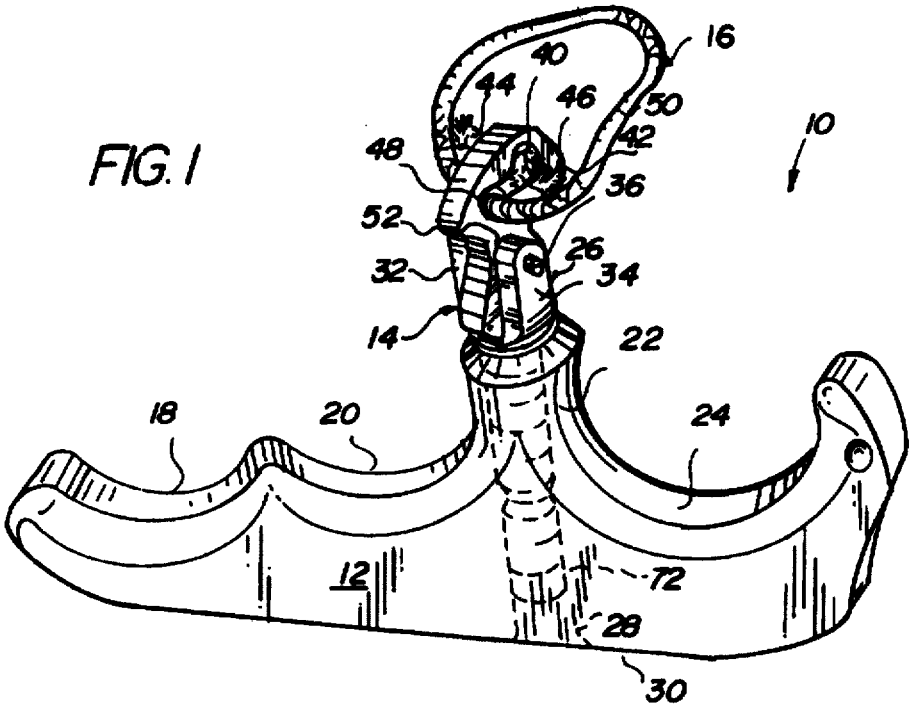
FIG. 1 is a perspective view of the rope release in accordance with this invention.
Figure 2:
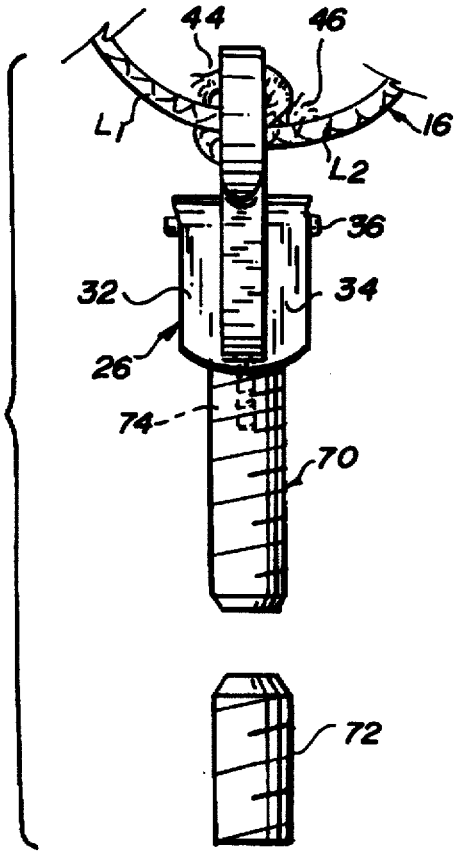
FIG. 2 is a an exploded partial front elevation view illustrating the catch member in FIG. 1 but without the handle, and illustrating an associated hollow stud and cooperating set screw.

With reference to FIGS. 1 and 2, the release device 10 in accordance with this invention includes a handle 12, a catch member 14 and a length of release rope 16 secured to the catch. The handle 12 illustrated in FIG. 1 is a three finger design, but it will be understood that other handle configurations such as two and four finger designs may be used as well. Thus, handle 12 includes finger grooves 18 and 20 on one side of a post 22, and a third finger groove 24 on the other side of the post 22. Post 22 serves as the mounting location for the catch member 14, with the aid of a fork member 26. The latter is threadably secured within a threaded throughbore 28 which extends through the post 22 to the back edge 30 of the handle 12.

The fork 26 includes a pair of split mounting legs 32, 34, between which the catch 14 is received. The latter is pivotally secured to the fork by means of a pin 36 which extends between the legs 32, 34, passing through the catch. Further details with respect to the mounting of the fork 26 in the handle 12 will be provided further below.

Figure 3:
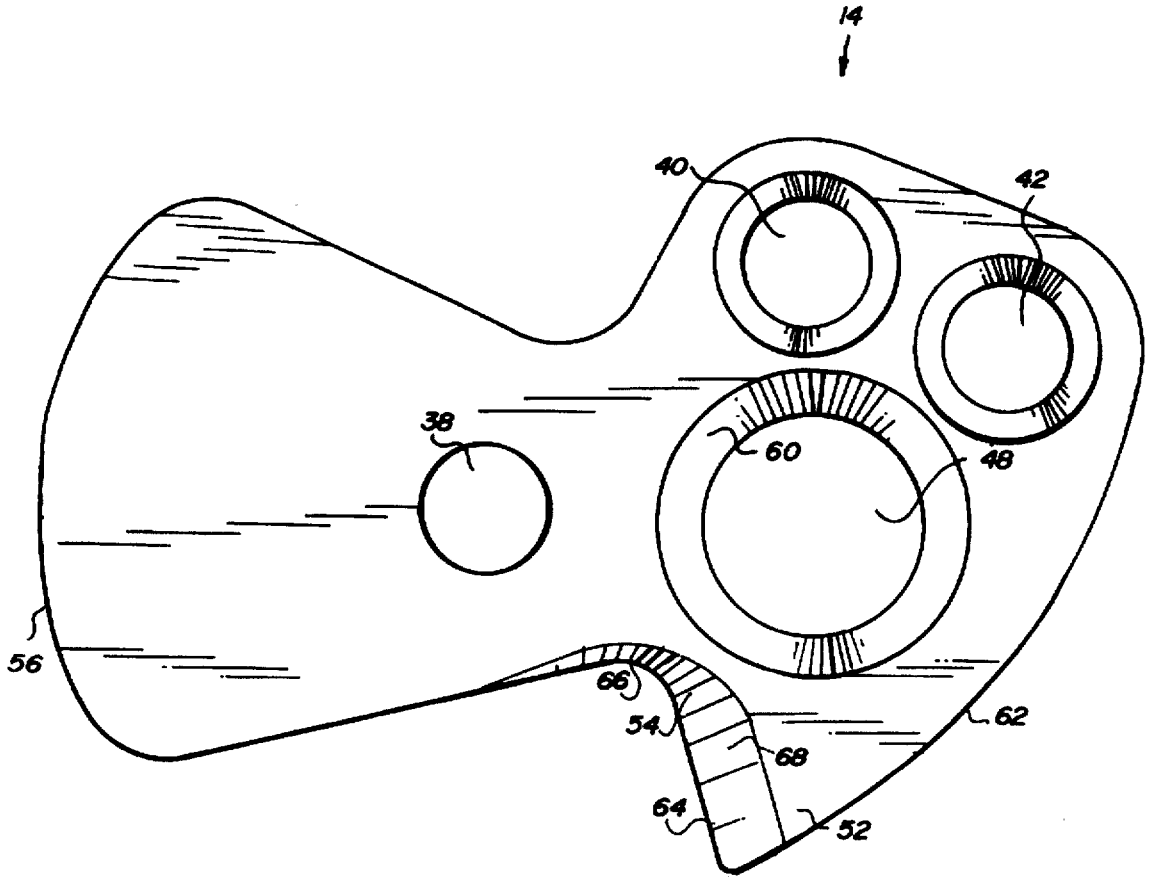
FIG. 3 is an enlarged side elevation of the catch member.

The catch member 14 is shown in detail in FIG. 3, and includes four functional portions or areas. First, the catch member is formed with a mounting hole 38 by which it is pivotally secured to the fork 26 by means of pin 36. Second, the catch member is provided with a pair of adjacent holes 40, 42 which are used to secure opposite free ends 44, 46 of the length of the rope 16, and a larger hole 48 through which both rope ends pass in opposite directions to form a closed loop 50. Third, the catch member 14 is formed with a spike 52 adjacent a groove 54 which retains the loop 50 formed in the rope 16. Fourth, the catch member 14 is formed with a rearward curved surface 56 which facilitates pivotal adjustment of the catch relative to the fork 28. These features will be described as necessary in greater detail below.

The body of the catch member 14 is planar, with opposite smooth sides slidably received between the legs 32, 34 of the fork 26. That portion of the catch to the right of mounting hole 38 as viewed in FIG. 3 will be referred to as the "forward end" of the catch, while that portion to the left of the hole 38 will be referred to as the "rearward end" of the catch. Thus, the forward end includes the rope holes 40, 42 and 48 as well as the spike 52 and groove 54. The rope holes 40, 42 are located remote from the spike 54, with hole 48 therebetween. Holes 40 and 42 may have radii of about 3/32 inch while hole 50 may have a radius of about 5/32 inch. The latter is surrounded by a beveled edge 60 on both sides of the catch to minimize wear on the release rope 16. With reference also to FIG. 1, it may be seen that one free end of the rope is passed through hole 48 and back through hole 40 where the tip of the rope is enlarged and fused (by glue, resin or other suitable means). The other end of the rope is passed through hole 48 in an opposite direction, then back through hole 42 and secured in the same manner. With this arrangement, two strands $L_1$ and $L_2$ of the rope 16 (see FIG. 2) extend out of the hole 50 from opposite sides of the catch 14 to insure that the closed loop 50 is generally symmetrical with respect to the catch member as shown in FIG. 1.

The spike 52 is formed by the intersection of a first curved surface 62 along the front edge of the catch member, and a second surface 64 which defines part of the adjacent groove 54. The base of the groove at 66 is formed with, e.g., a 0.047" radius. Surface 64 is rounded on either side of the catch as shown at 68 to reduce wear on the release rope 16. Surface 64 is engaged by the loop 52 under draw conditions as described below.

The rearward curved surface 56 may have a radius of about 0.3125 inch from the center pivot hole 36, and it is this surface which is used to alter or adjust the rotation of the catch member 14 about the pivot pin 36.

Referring now to FIG. 2, the fork 26 is secured at its base to a hollow stud 70 which is threaded on both interior and exterior surfaces. Thus, the stud 70 may be threadably inserted into the post 22 from the forward end (that end closest the release rope 16) thereof. A first set screw 72 may then be threadably inserted within the bore 28 from the back side 30 of the handle 12 until it abuts the end of the stud 70. In this way, the rotational orientation of the catch 14 relative to the handle about a first axis on the longitudinal centerline of the post can be adjusted as desired. In other words, with the catch rotated to the desired angle relative to the handle 12, the set screw 72 is tightened to lock the fork 28 and catch 12 in place. With this arrangement, the archer can pre-adjust the rotational angle of the catch 14 so that, at full draw, there is no torque or twist in the rope loop 50, while accommodating the normal twist in the archer's own wrist.

A second, smaller set screw 74 is threadably inserted within the interior of the stud 70 and bears on the surface 56 of the catch member 14. By loosening the screw 74, the catch 14 can be adjusted about a second axis perpendicular to the first axis, i.e., the pivot pin 36, to the desired catch angle. To facilitate adjustment of the catch about the pin 36, the first set screw 72 is also made hollow to thereby enable access to the set screw 74 through the set screw 72 and stud 70 even after the fork 26 and catch 14 are rotationally locked. This second adjustment of the catch 14 within the fork 26 adjusts the back tension on the rope loop 50, and determines the amount of movement necessary to release the loop 50 (and hence the bowstring) from the spike 52.

The adjustability features of the present invention eliminate torque when the hand or wrist is rotated at full draw, and provide desired back tension to improve both speed and accuracy.

The release device in accordance with this invention, with the exception of the release rope, may be constructed of various materials. Presently preferred materials are CNC machined aluminum for the handle and stainless steel for the fork 26 and catch member 14 but other materials may be employed.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rope release for a bowstring comprising:

a handle;

a fork mounted in said handle for adjustable rotation relative thereto about a first axis;

a rope release catch member mounted in said fork for adjustable rotation relative to said fork member about a second axis perpendicular to said first axis; and a rope release fixed to said catch with a closed loop adapted to be releasably engaged by a spike formed integrally on said catch member.

2. The rope release of claim 1 wherein said handle includes a plurality of finger grooves and a post, said post having a threaded throughbore in which said fork is mounted.

3. The rope release of claim 2 wherein said fork includes a threaded stud received in said threaded throughbore and wherein a set screw is used to lock said stud and said fork in a rotational orientation relative to the handle.

4. The rope release of claim 3 wherein a second set screw is introduced into said threaded stud for engagement with a surface of said catch member to thereby lock said catch member in a rotational orientation relative to the fork.

5. The rope release of claim 2 wherein said first axis lies on a longitudinal centerline of said post.

6. The rope release of claim 1 wherein said rope release catch member includes a rope retaining groove adjacent said spike.

7. The rope release of claim 6 wherein said rope release catch member includes a curved rear surface adapted to be engaged by said second set screw.

8. The rope release of claim 1 wherein said catch member is formed with three release rope holes, wherein two free ends of said rope release are secured within two of said three holes, and wherein end portions adjacent said free ends pass through the third of said three holes to thereby provide said closed loop.

9. The rope release of claim 1 wherein said fork includes a pair of split mounting legs with a pivot pin supporting said catch member extending between said legs.

10. The rope release of claim 1 wherein said catch member is constructed of stainless steel.

11. The rope release of claim 1 wherein said fork is constructed of stainless steel.

12. The rope release of claim 1 wherein said handle is constructed of aluminum.

* * * * *